United States Patent [19]

Teel

[11] Patent Number: 4,514,923

[45] Date of Patent: May 7, 1985

[54] TRIGGER ACTUATOR

[76] Inventor: Patrick Teel, 5215 11th Ave., Minneapolis, Minn. 55417

[21] Appl. No.: 615,929

[22] Filed: May 31, 1984

Related U.S. Application Data

[63] Continuation-in-part of Ser. No. 413,859, Sep. 1, 1982, abandoned.

[51] Int. Cl.[3] ..... F41C 19/00

[52] U.S. Cl. ..... 42/69 R

[58] Field of Search ..... 42/1 P, 1 Y, 69 R, 69 A, 42/69 B

[56] References Cited

U.S. PATENT DOCUMENTS

| | | | |
|---|---|---|---|
| 1,909,425 | 5/1933 | Reid | 42/69 R |
| 2,589,227 | 3/1952 | Colley | 42/69 |
| 2,920,413 | 1/1960 | Marhefka et al. | 42/69 |
| 3,021,763 | 2/1962 | Beretta | 89/140 |

*Primary Examiner*—Charles T. Jordan
*Assistant Examiner*—Ted L. Parr
*Attorney, Agent, or Firm*—Kinney & Lange

[57] ABSTRACT

A trigger actuator device is pivotally attached to a fire arm proximate a trigger of the firearm. The device includes a lever member for manual engagement that is pivotally mounted to the firearm and has a pair of joined spaced-apart plate members disposed about both sides of the trigger and extending forward of the trigger. First and second pin members are disposed forwardly of the trigger extending between the spaced-apart plates and are positioned in relation to the trigger such that when the lever member is pivoted in one direction, the first pin member engages an upper portion of the trigger, actuating the trigger, and when the lever member is pivoted in another opposing direction, the second pin member engages a lower portion of the trigger, actuating the trigger.

3 Claims, 14 Drawing Figures

Fig. 7
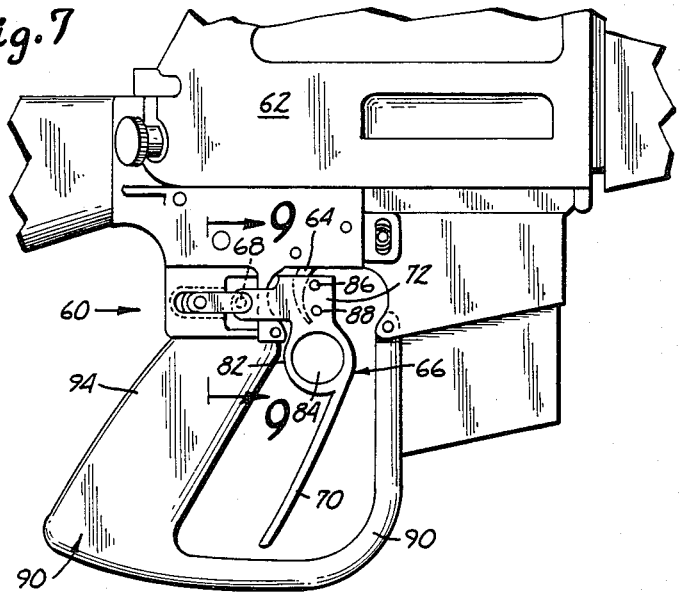
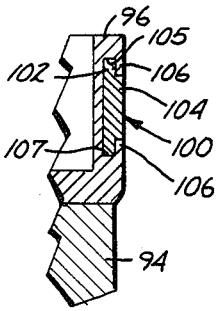
Fig. 9
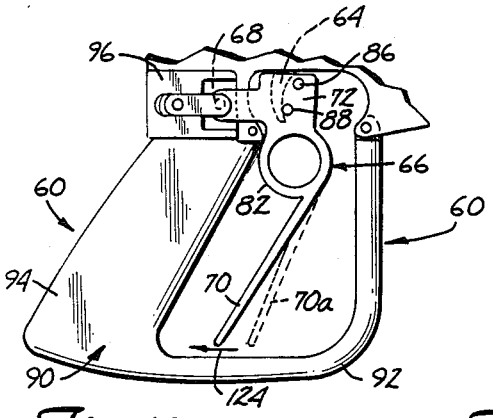
Fig. 10
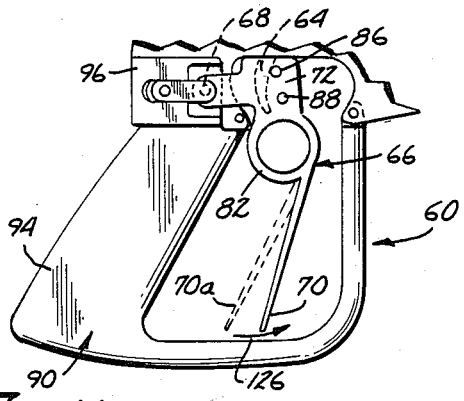
Fig. 11
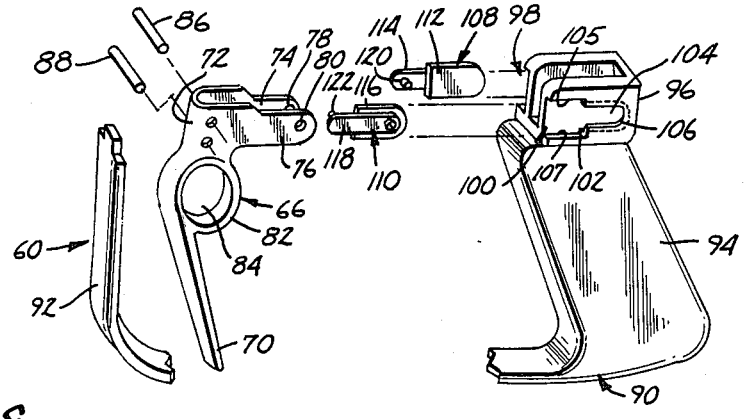
Fig. 8

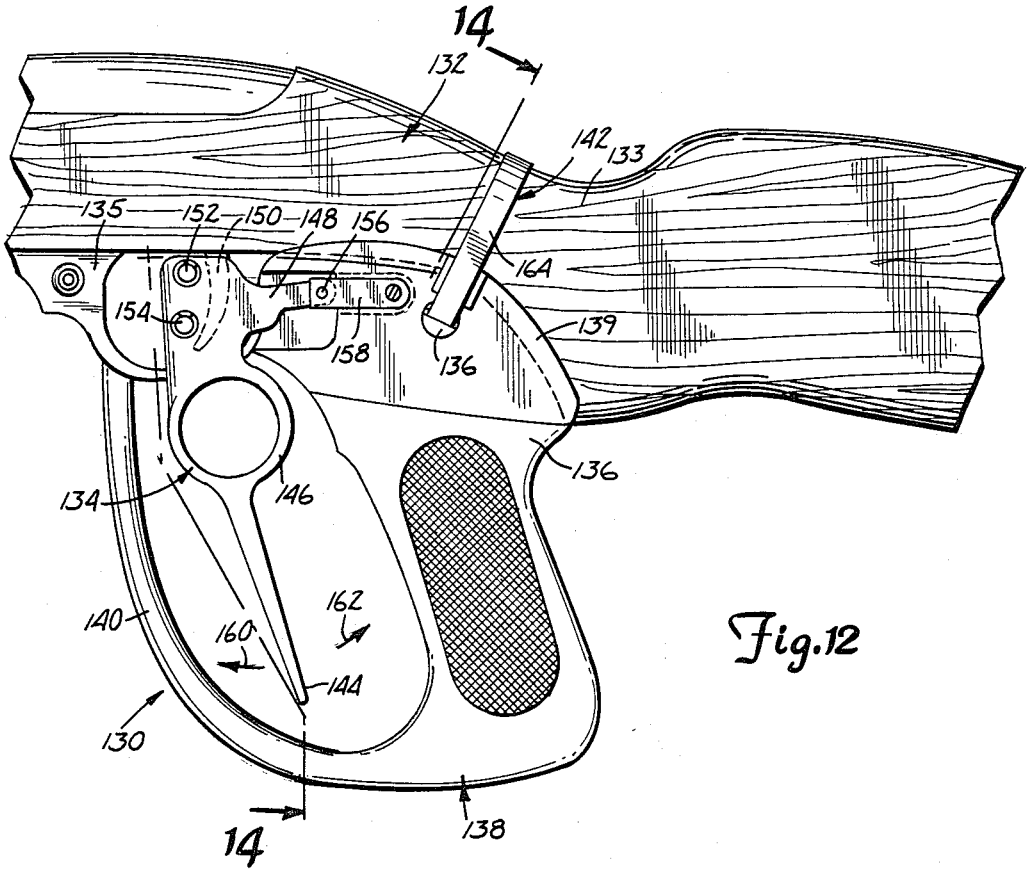
Fig.12
Fig.13
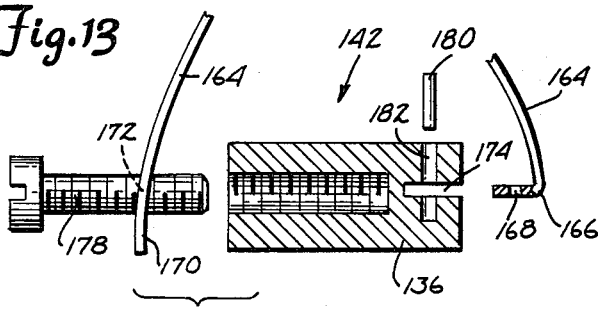
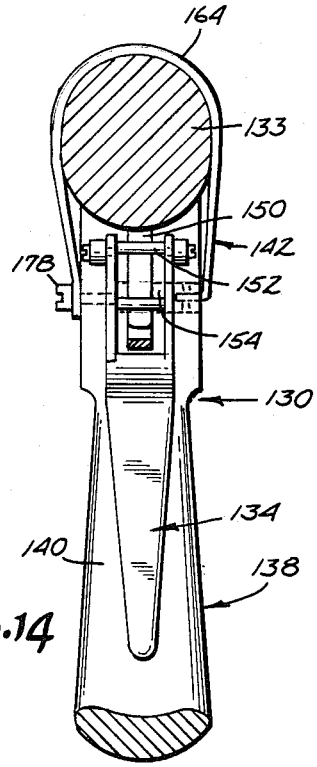
Fig.14

TRIGGER ACTUATOR

REFERENCE TO CO-PENDING APPLICATION

This application is a continuation-in-part of pending application Ser. No. 413,859 filed Sept. 1, 1982, abandoned.

BACKGROUND OF THE INVENTION

1. Field of the Invention.

The present invention relates generally to firearms, and in particular, it relates to actuator devices for actuating the trigger of a firearm.

2. Description of the Prior Art.

There has been a growing appreciation of the use of firearms as a sport and in recreation. In the case of a rifle that includes a trigger mechanism that fires a round and then is automatically reset to fire a subsequent round, the movement of the user's finger in actuating the trigger is not a fluid movement. The user must pull back on the trigger and then release the trigger and pull back once again to fire the subsequent round. This movement is not efficient and at times can even disturb the aim of the user. If the movement were more fluid, a more accurate and rapid discharge of the firearm could be achieved. However, due to governmental firearm restrictions on fully automatic weapons, the trigger must be actuated separately for the discharge of each round.

In the Reid U.S. Pat. No. 1,909,425 a trigger mechanism is described in which the parts are arranged so that there is no appreciable change in pressure of the trigger against the trigger finger at the instant the lock mechanism is released for firing. The trigger mechanism includes an auxiliary trigger pivotally mounted in a position forward of the actual trigger and has a trigger-actuating pin member positioned on the backside of the auxiliary trigger. The trigger-actuating pin member on the auxiliary trigger engages a lug or roller on a forward upper portion of the main trigger. When the auxiliary trigger is pulled back, the trigger-actuating pin member engages the lug or roller pushing back the main trigger and discharging the firearm. Although the auxiliary trigger descreses the pressure needed to pull back the main trigger, the same inefficient motion to pull back the main trigger to fire each round is used.

The Marhefka et al U.S. Pat. No. 2,920,413 describes a mechanism for actuating the trigger of a firearm while wearing heavy mittens, gloves and similar articles of handwear. The mechanism includes a bar having the contour of the trigger guard that is hinged to the lower end of a clip slide assembly which is attached to the trigger guard for free sliding along thereof. The bar is pivoted to the rear whereupon the wearer squeezes the bar, using the trigger guard as a fulcrum and causing a rearward force upon the trigger to fire the weapon. The mechanism of the Marhefka et al Patent, however, does not provide an efficient motion to increase the discharge rate of the firearm.

The Beretta U.S. Pat. No. 3,021,763 describes a mechanism for converting a rifle from semi-automatic to automatic firing. However, the mechanism described in the Beretta Patent is incorporated with the components of the semi-automatic rifle and the user must still pull back on the trigger. In addition, it appears that the mechanism of the Beretta Patent also violates government restrictions on automatic weapons since the trigger is only actuated once to discharge all the rounds.

The Colley U.S. Pat. No. 2,589,227 describes a trigger conversion device for rifles which permits the discharge of the rifle when the user is wearing heavy mittens or other types of winter handgear which would prohibit engagement of the individual's finger with the trigger of the rifle. The device includes a plate which is screwed into the stock of the rifle rearwardly of the trigger housing. A pivotal member is pivotally attached to the plate and extends forwardly. The pivotal member has a yoke with arms that extend on either side of the trigger guard. The arms have ends that extend forward of the trigger. A triangular trigger-engaging block includes a base that conforms to the curvature of the trigger. The block is pivotally attached to a forward end of the arms of the yoke by a pin. The user pulls in an upwardly direction on the pivotal member and the trigger-engaging block pulls back on the trigger. To discharge a subsequent round, the pivotal member must be released for the trigger to move forwardly with the user subsequently pulling up on the pivotal member.

SUMMARY OF THE INVENTION

The present invention includes a trigger actuator device having a lever member pivotally attached to the firearm at one end and having a second free end for manual engagement by the user. The lever member includes a pair of spaced-apart plate members that are disposed on both sides of the trigger and extend forwardly of the trigger. First and second trigger-actuating pin members extend between the plate members forward of the trigger in a spaced-apart relationship and in relation to the trigger such that when the free end of the lever member is swung in one direction, the first pin member engages the trigger at an upper portion, actuating the trigger and when the free end is swung in an opposing direction, the second pin member engages a lower portion of the trigger, activating the firearm. The swinging pivotal motion of the pivot member provides an efficient movement to discharge the trigger. In addition, the discharge rate of the firearm is increased since both a forwardly and a rearwardly movement is used to actuate the trigger of the firearm.

BRIEF DESCRIPTION OF THE DRAWINGS

FIG. 7 is an elevational view of an improved preferred alternative embodiment of the trigger actuator of the present invention shown attached to a firearm.

FIG. 8 is an exploded perspective view of the preferred embodiment of the trigger actuator illustrated in FIG. 7.

FIG. 9 is a cross-sectional view showing one of the slots of the trigger actuator taken along the line 9—9 in FIG. 7.

FIGS. 10 and 11 are elevational views of the improved preferred embodiment of the trigger actuator of FIG. 7 in actuating positions.

FIG. 12 is an elevational view of an improved preferred alternative embodiment of the trigger actuator of the present invention attached to a firearm.

FIG. 13 is an exploded cross-sectional view of a clamping assembly for securing the trigger actuator of FIG. 12 to the firearm.

FIG. 14 is a cross-sectional view taken generally along the line 14—14 in FIG. 12.

DETAILED DESCRIPTION OF THE PREFERRED EMBODIMENTS

Figure 1:
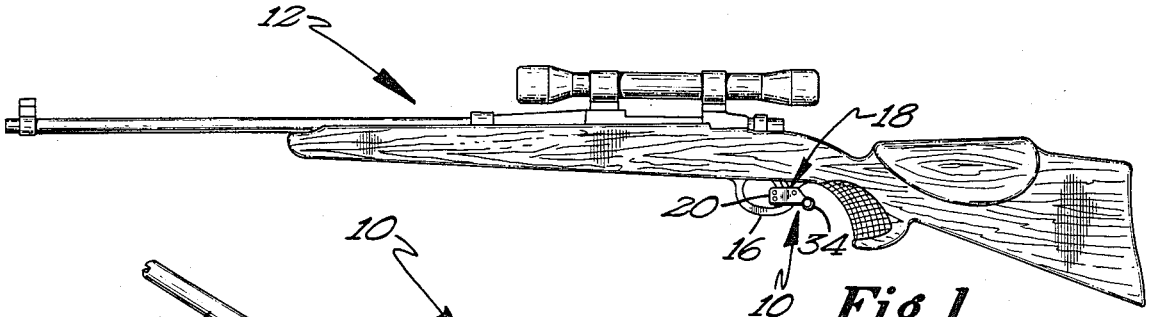
FIG. 1 is an elevational view of the trigger actuator of the present invention attached to a firearm.
Figure 2:
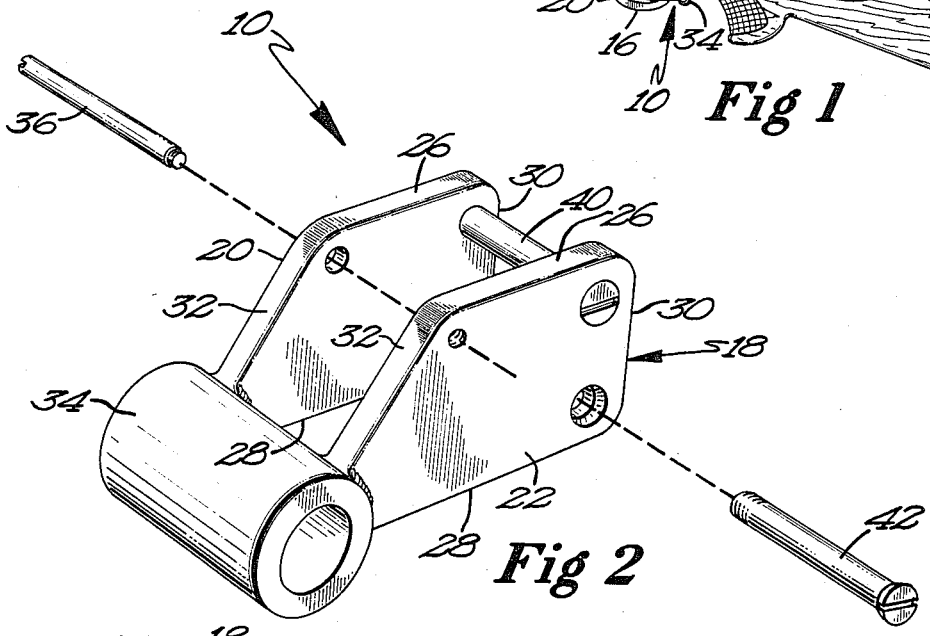
FIG. 2 is a perspective view of the trigger actuator.
Figure 3:
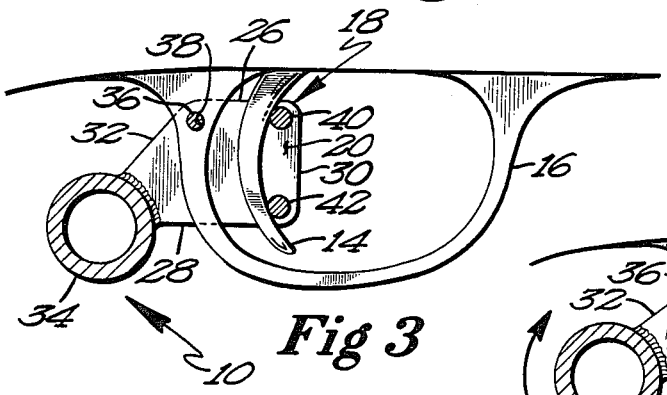
FIGS. 3–5 are cross-sectional views of the trigger actuator of FIG. 1 in its normal and actuating positions.
Figure 4:
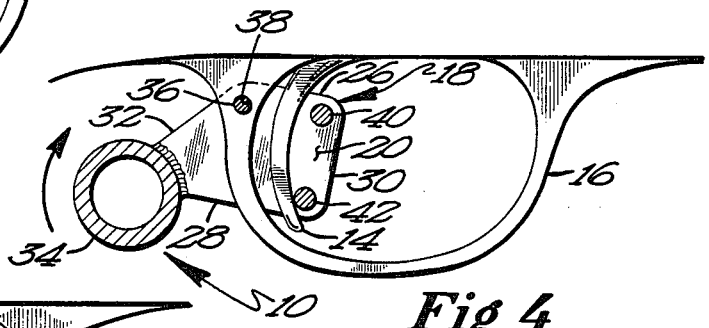
Figure 5:
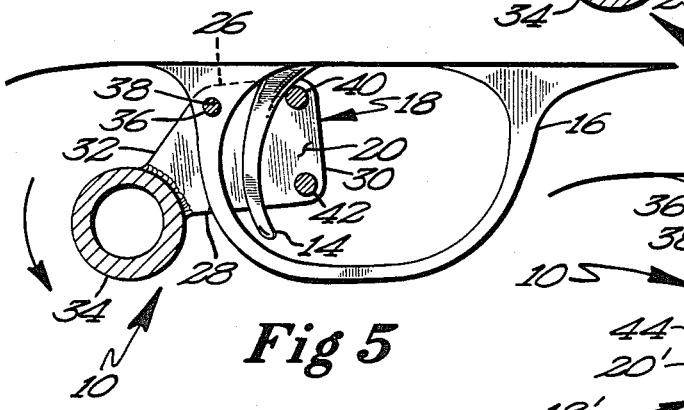
Figure 6:
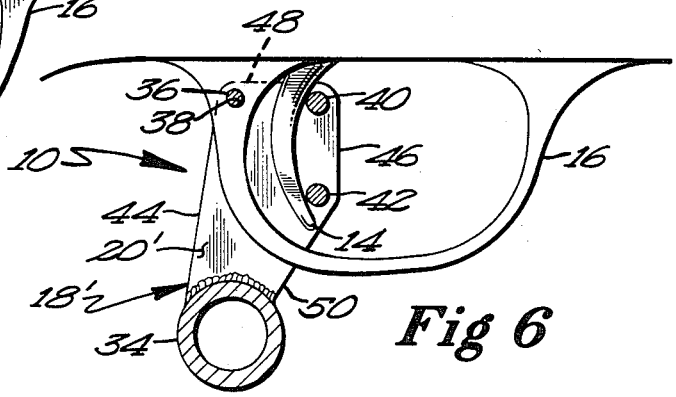
FIG. 6 is a cross-sectional view of an alternative embodiment of a trigger actuator of the present invention.

A trigger actuator is generally indicated at 10 in FIG. 1. The trigger actuator is pivotally attached to a firearm 12. The firearm 12 is shown in the preferred embodiment as a rifle and includes a disconnector or trigger 14 and a trigger guard 16. The trigger 14 is movable between a normal, non-fire position, as best seen in FIGS. 3 and 6, and a rearward actuated fire position, as best seen in FIGS. 4 and 5.

The actuator device 10 includes a pivotal lever 18 that includes first and second generally parallel, spaced-apart plates 20 and 22. The plates 20 and 22 generally include first and second parallel side edges 26 and 28, a third edge 30 which is generally perpendicular to the first and second edges 26 and 28, and a fourth end edge 32 which intersects with edge 26 at an obtuse angle and which intersects with edge 28 at an actue angle. The lever 18 further includes a tubular member 34 attached between plates 20 and 22 generally at the intersection of edges 28 and 32 of the plates 20 and 22. The tubular member 34 provides a point of engagement by the user's finger at a free end of the device 10.

The device 10 further includes a pivot pin 36 which extends between first and second plates 20 and 22. The pivot pin 36 is preferably pivotally attached to the trigger guard 16 of the firearm 12 through an aperture 38 formed in the trigger guard 16 behind the trigger 14. The pivot pin 36 permits pivoting of the actuating lever 18 about an axis from a first, "normal" position, a second, "firing" position, and a third, "firing" position, in an opposing direction from the second, firing position. The second, "firing" position is located in a pivotal direction opposite of the direction of moving the trigger 14 from its non-fire position to its fire position. The third, "firing" position is located in a pivotal direction the same as the direction of moving the trigger 14 from its non-fire position to its fire position.

The actuator device further includes first and second trigger-actuating pin members 40 and 42. In the embodiment shown in FIGS. 1–6, the pin members 40 and 42 are screws which extend between the first and second plates 20 and 22.

It should be noted that in the embodiment of FIGS. 1–6, the tubular member 34, the pivot pin 36 and the trigger-actuating pins 40 and 42 hold plates 20 and 22 in their parallel spaced relationship without any further securement of any kind. Thus, although maximizing the use of little material and being of inexpensive fabrication, the actuator device 10 is of a rigid and durable construction.

The first trigger-actuating pin member 40 is located on the actuating lever 18 to move the trigger 14 from its non-fire position to its fire position when the actuating lever 18 is pivoted from its first, "normal" position to its second, "fire" position. It should be noted that the trigger-actuating pin member 40 is positioned so it does not actuate trigger 14 when the actuating lever is located in its first, "normal" position or when the actuating lever 18 is pivoted from its first, "normal" position to its third, "fire" position. Preferably, the trigger-actuating pin member 40 is located adjacent the junction of side edges 26 and 30 to engage an upper portion of the trigger 14.

The second trigger-actuating pin member 42 is located on the actuating lever to move the trigger 14 from its non-fire position to its fire position when the actuating lever 18 is pivoted from its first, "normal" position to its third, "fire" position. It should also be noted that the trigger-actuating pin member 42 is preferably positioned so it does not actuate the trigger 14 when the actuating lever is located in its first, "normal" position or when the actuating lever is pivoted from its first, "normal" position to its second, "fire" position. Preferably, the pin member 42 is located adjacent the intersection of edges 22 and 30 so that it engages a lower portion of the trigger 14.

In the first, "normal" position, the first and second pin members 40 and 42 do not actuate the trigger 14. In its second, "fire" position, the pin member 40 actuates the trigger 14 by engaging an upper portion thereof and moving it from its non-fire position to its fire position, thus firing the firearm 12. In its third, "fire" position, the pin member 42 actuates the trigger 14 by engaging the trigger at a lower end portion thereof and moving it from its normal non-fire position to its fire position, thus firing firearm 12.

FIG. 6 illustrates an alternative embodiment of the actuating lever 18'. The lever 18' is likewise formed from a first plate 20' and a second parallel spaced plate. The plates generally include first and second side edges 44 and 46, and third and fourth end edges 48 and 50. The edge 48 intersects with the edge 46 at a right angle. The edge 48 intersects with the edge 44 at an obtuse angle. The edge 50 intersects with the edge 46 at an obtuse angle also. The edge 44 intersects with the edge 50 at an acute angle. The tubular member 34 is located at the intersection of the edges 44 and 50 at a free end portion of the lever 18'.

It should be noted that in the embodiment shown in FIGS. 1–6, a unique relationship exists between the pivot 36 and pin members 40 and 42. Specifically, the pin members 40 and 42 are located such that the angular relationship between a line between the pivot axis defined by the pivot pin 36 and the pin member 40 and a line between the first and second pin members 40 and 42 is a right angle. Furthermore, a line between the pin member 40 and the pivot 36 in conjunction with the angular relationship of the pivot 36 and the pin members 40 and 42 forms a right triangle. These relationships have been found to be advantageous in utilizing the device 10 shown in FIGS. 1–6.

Furthermore, the actuating levers 18 and 18' are of a length that extends beyond the trigger guard 16 to allow actuation of the levers 18 and 18' outside of the trigger guard 16. Further, due to the preferred shape of the lever 18, the tubular member 34 and the actuating lever 18 extend generally behind trigger guard 16 so that the finger of the operator can actuate the actuator device 10 generally behind the trigger guard 16. Likewise, due to the preferred shape of the lever 18', the tubular member 34 and the actuating lever 18 extends generally below the trigger guard 16 so that the finger of the operator can actuate the actuator device 10 generally below the trigger guard 16.

It should then be appreciated that the actuator device 10 can be pivoted from its first position to its third, "fire" position by placing the finger within the trigger guard 16 to abut against edges 26 and 46 of the levers 18 and 18', respectively, if desired. Thus, in this mode of operation, the trigger 14 is actuated in a substantially similar manner as when the actuator is not attached to the firearm 12.

First, as is will known in the art in long range firearms, any slight movement of the firearm when the trigger 14 is actuated can cause great variance of the path of the bullet discharged from the firearm. Rearward movement of the trigger 14 from its non-fire to its fire position often causes the firearm to jerk, thus causing inaccuracy in travel of the bullet. The actuator device 10 then allows the actuation of the trigger 14 from the forward movement of the actuator device 10 which causes less jerk and thus greater firearm accuracy. Therefore, the actuator device 10 can be used in a variety of firearms to increase accuracy, including single shot-type firearms.

Furthermore, with the actuator device 10 of the present invention, the user has the option to actuate the trigger 14 within the trigger guard 16 or outside the trigger guard by actuating the actuator device 10 either forward to its second position or rearward to its third position. The actuator device 10 also increases the firing rate obtainable in discharging the firearm 12. Specifically, the lever 18 can be moved from its first position to either of its second or third positions, and then reciprocated between its second and third positions with the firearm discharging whenever the actuating lever is located in its second and third positions. It can then be realized that the firearm 12 can be discharged at a much more rapid rate utilizing the actuator device 10 than if the trigger 14 is actuated manually without the use of the actuator device 10. Furthermore, since the trigger 14 is pivoted to its first, non-fire position between actuations, the actuator device 10 does not violate present recreational firearm laws relating to fully automatic-type firearms.

FIGS. 7–11 illustrate an improved preferred alternative embodiment of the trigger actuator of the present invention generally indicated at 60. Referring to FIG. 7, the trigger actuator 60 is illustrated attached to a firearm 62, specifically an AR-15 manufactured by Colt of Connecticut. The AR-15 is a gas-operated semi-automatic rifle requiring each round to be fired by pulling back on a trigger 64. The AR-15 has a detachable pistol grip and trigger guard (not shown). The improved trigger actuator illustrated in FIGS. 7–11 replaces the pistol grip and trigger guard of the AR-15. It should be understood that although the AR-15 is specifically illustrated, the trigger actuator 60 may be modified within the scope of the present invention for use with other firearms.

The trigger actuator 60 includes a pivotal lever 66 pivotally attached in relation to the rifle 62 at pivot point 68 and having a free end portion 70 for manual engagement by the user. The lever 66 includes an upper generally yoke configured portion 72 having first and second rigid plate members 74 and 76 extending rearwardly on both sides of the trigger 64. Each plate member 74 and 76 has a rearward end portion with coaxially aligned apertures 78 and 80, respectively, disposed along pivot point 68. The lever 66 further includes a middle ring portion 82 having an aperture 84 sufficiently large to accommodate a finger (not shown). The free end portion 70 extends from the middle ring portion 82 in a downwardly direction slightly inclined towards the rear when in a non-fire position.

Upper and lower pin members 86 and 88, respectively, are attached to and extend between the plate members 74 and 76. The pin members 86 and 88 are disposed forward of the trigger 64 with the upper pin member 86 being positioned to engage an upper portion of the trigger 64 and the lower pin member 88 being disposed to engage a lower portion of the trigger 64 when the lever 60 is positioned in its actuating position as will be discussed subsequently.

Preferably, the trigger actuator 60 includes a forward trigger guard 90 having a forward guard portion 92 and a pistol grip portion 94. The trigger guard 90 is preferably of a unitary construction.

As stated previously, the trigger guard 90 replaces the detachable pistol grip and tripper guard of the AR-15. The forward portion 92 of the trigger guard is suitably attached to the rifle 62 in the same manner as the AR-15 trigger guard. The pistol grip portion 94 is also attached to the rifle 62 in the same manner as the AR-15 pistol grip.

The pistol grip portion 94 has an upper section 96 with retaining slots 98 and 100. The retaining slots 98 and 100 are disposed on both side of the upper section 96 in a substantially parallel relationship and are disposed so that when the trigger actuator of the present invention is attached to the rifle, the slots 98 and 100 are disposed in a substantially parallel relationship to the longitudinal axis of the rifle. Each slot 98 and 100 is of a similar configuration and both slots will be described with reference to the slot 100. The slot 100 has an inner and outer slot track portion 102 and 104, respectively, as best illustrated in FIG. 9. The inner track portion 102 is defined by straight outwardly extending sides 105 and 107 bounded by a plane formed by a flange portion 106, as best illustrated in FIGS. 8 and 9. The outer track portion is defined by the inwardly facing edges of the flange 106. The flange 106 is preferably flush with the outer surface of the upper section 96.

Right and left slot followers 108 and 110 engage slots 98 and 100, respectively. The slot follower 108 includes an inner slot track following portion 112 and an outer slot track following portion 114 for engaging the inner and outer slot track portions of the slot 98, respectively. Similarly, the slot follower 110 includes an inner slot track following portion 116 and an outer slot track following portion 118 for engaging the inner and outer slot track portions of the slot 100, respectively. As is easily understood from the drawings, the inner slot track follower of the followers 108 and 110 are held within their respective track portions by the flange 106 and are allowed to move freely in a generally forward and a rearward direction while retaining the followers within their respective slots.

An inwardly extending pivot pin portion 120 is positioned on the outer track following portion 114. Similarly, an inwardly extending pivot pin portion 122 is disposed on the outer track following portion 118. The pivot pin portion 120 cooperates with the aperture 78 and the pivot pin portion 122 cooperates with the aperture 80 permitting pivotal movement of the lever 66 about the pivot point 68.

As illustrated in FIG. 10, the lever 66 is actuated by manually engaging the lower free end 70 and pulling back in the direction of arrow 124 from an initial position indicated by broken line 70*a*. Pulling back on the lower free end 70 results in the lever 66 pivoting about the pivot point 68 with the lower pin 88 engaging the trigger 64 and discharging a round.

To discharge a subsequent round, the free end 70 is pushed in a forwardly direction indicated by arrow 126.

The lever 66 pivots about pivot point 68 and the upper pin 86 actuates the trigger 64 at an upper portion thereof, discharging the round.

Alternatively, the ring portion 82 may be used to move the lever 66 to the actuating positions illustrated in FIGS. 10 and 11, by simply inserting a finger (not shown) within the ring and moving the lever in either pivotal direction.

Slot followers 108 and 110 move within the slots 98 and 100, respectively, permitting the pivot point 68 to "float". The floating of the pivot point 68 provides flexibility to the movement of the lever so that the pin members 86 and 88 engage the trigger 64 properly.

In FIGS. 12–13, a further improved preferred alternative embodiment is generally indicated at 130. The trigger actuator 130 is mountable on a rifle 132 not having a pistol grip but a more traditional stock 133 and a trigger guard 135 surrounding a trigger 150, such as a Ruger 10/22 manufactured by the Stern, Ruger & Co. of Connecticut. The actuator 130 is similar in construction to the actuator 60 illustrated in FIGS. 7–11 and includes a pivotal lever 134 pivotally attached to the rifle 132 and a trigger guard 138 having a forward trigger guard portion 140 and a pistol grip portion 136. The trigger actuator is strapped to the rifle 132 by a clamp assembly 142. The pivotal lever 134 has a free end 144, a mid-ring section 146 and an upper portion 148 that has a yoke-type configuration. The upper portion 148 has left and right plate members that extend from a position forward of the trigger to a position rearward of the trigger 150 on both sides of the trigger 150. Extending between the plate members forward of the trigger 150 are an upper pin member 152 for engaging an upper section of the trigger 150 and a lower pin member 154 for engaging a lower section of the trigger 150. The lever 134 is pivotally attached at a pivot point 156 to an upper portion 139 of the pistol grip portion 136 in a similar fashion as the lever 60 in FIGS. 7–11. Right (not shown) and left track follower 158 engage respective slots similar to the slots illustrated in FIGS. 7–11 and have similar pin members (not shown) which engage the lever 134, permitting the pivot point 156 to "float".

The lever 134 is similarly operated at the lever 66 illustrated in FIGS. 7–11. The lever may be either moved in a rearward direction as indicated by arrow 162 so that the pin member 154 engages a lower portion of the trigger 150 and the lever can be moved in a forward direction as indicated by arrow 160 so that the pin member 152 engages an upper portion of the trigger 150.

The trigger actuator 130 mounts against an underportion of the stock 133 with the upper portion 139 of the pistol grip portion abutting against the underside of the stock 133. The forward trigger guard portion 140 abuts against the trigger guard 135. The clamp assembly 142 includes a steel strap 164 having an inwardly bent end portion 166 with an aperture 168 disposed from the end thereof and a second end portion 170 having an aperture 172 disposed from the end thereof as best illustrated in FIG. 13. The upper portion 139 includes an aperture 174 for receiving the first end portion 166 of the strap 164. A threaded aperture is disposed on an opposite side of the upper portion 139 for receiving a bolt 178 that extends through the aperture 172 into the aperture. A retaining pin 180 insertable engages a pin receiving aperture 182 that is disposed substantially perpendicularly to the aperture 174. The pin 180 is inserted into the aperture 182 after the end portion 166 is inserted into the aperture 174 with the pin 180 extending through the aperture 168 of the first end portion 166 of the strap 164. The steel strap 164 securely holds the trigger actuator 130 in position as is further illustrated in FIG. 14.

Although the present invention has been described with reference to preferred embodiments, workers skilled in the art will recognize that changes may be made in form and detail without departing from the spirit and scope of the invention.

I claim

1. A trigger-actuating device for use in a firearm having a trigger, with the trigger being movable between a normal non-fire position and a fire position, the device comprising:

an actuator lever pivotally attachable to the firearm at one end and having a second, free end for manual engagement and the lever having first and second side members extending along both sides of the trigger to a position forward of the trigger;

means for pivotally attaching the actuating lever to the firearm including a trigger guard assembly having a pistol grip portion and a forward guard portion and means for fixedly attaching the pistol grip portion to the firearm and first and second slots disposed within the pistol grip portion and first and second slot followers in sliding relationship with the slots and each slot follower having a pin portion extending therefrom pivotally engaging the actuating lever;

a first pin member extending between the side members at a position forward of an upper section of the trigger;

a second pin member extending between the side members forward of a lower portion of the trigger; and wherein the first and second pin members are positioned such that when the free end of the lever is moved in a first direction, the first pin member engages the upper portion of the trigger actuating the trigger, and when the free end of the actuating lever is moved in an opposing second direction, the second pin member engages a lower end portion of the trigger actuating the trigger.

2. The device of claim 1 wherein the means for fixedly attached the trigger guard assembly to the firearm includes a clamping assembly having a strap for encircling a stock of the firearm and means for securing end portions of the strap to the trigger guard portion such that the trigger guard assembly is held securely to the firearm.

3. The device of claim 1 wherein the actuating lever includes a middle ring portion for manual engagement.

* * * * *